US005464327A

United States Patent [19]

Horwitz

[11] Patent Number: 5,464,327

[45] Date of Patent: Nov. 7, 1995

[54] WATER PRESSURE CONTROL SYSTEM

[75] Inventor: Robert P. Horwitz, Orange, Calif.

[73] Assignee: ITT Corporation, New York, N.Y.

[21] Appl. No.: 159,631

[22] Filed: Dec. 1, 1993

[51] Int. Cl.[6] ..... F04B 49/00

[52] U.S. Cl. ..... 417/12; 417/20; 417/25; 417/43; 417/44.2; 417/44.8

[58] Field of Search ..... 417/12, 20, 25, 417/43, 44.8, 44.2, 44.4

[56] References Cited

U.S. PATENT DOCUMENTS

| | | | |
|---|---|---|---|
| 3,702,742 | 11/1972 | Russell | 417/25 |
| 4,874,294 | 10/1989 | Karg | 417/43 |
| 5,064,347 | 11/1991 | LaValley, Sr. | 417/12 |
| 5,259,733 | 11/1993 | Gigliotti et al. | 417/44.4 |

FOREIGN PATENT DOCUMENTS

| | | | |
|---|---|---|---|
| 0047101 | 4/1979 | Japan | 417/25 |
| 0153301 | 12/1979 | Japan | 417/25 |
| 0125381 | 9/1980 | Japan | 417/25 |

*Primary Examiner*—Richard A. Bertsch
*Assistant Examiner*—Xuan M. Thai
*Attorney, Agent, or Firm*—Menotti J. Lombardi

[57] ABSTRACT

A water pressure control system in which the pressurizing pump is turned on only in response to low pressure but is turned off only in response to low water flow rates. Water flow is detected with a magnetic switch displaced by water movement. After the pump is turned on, it can not be turned off for ten seconds, to smooth operation. When the system is first activated, the pump is turned on for sixty seconds, without regard to the other control functions, to guarantee priming of the pump.

11 Claims, 1 Drawing Sheet

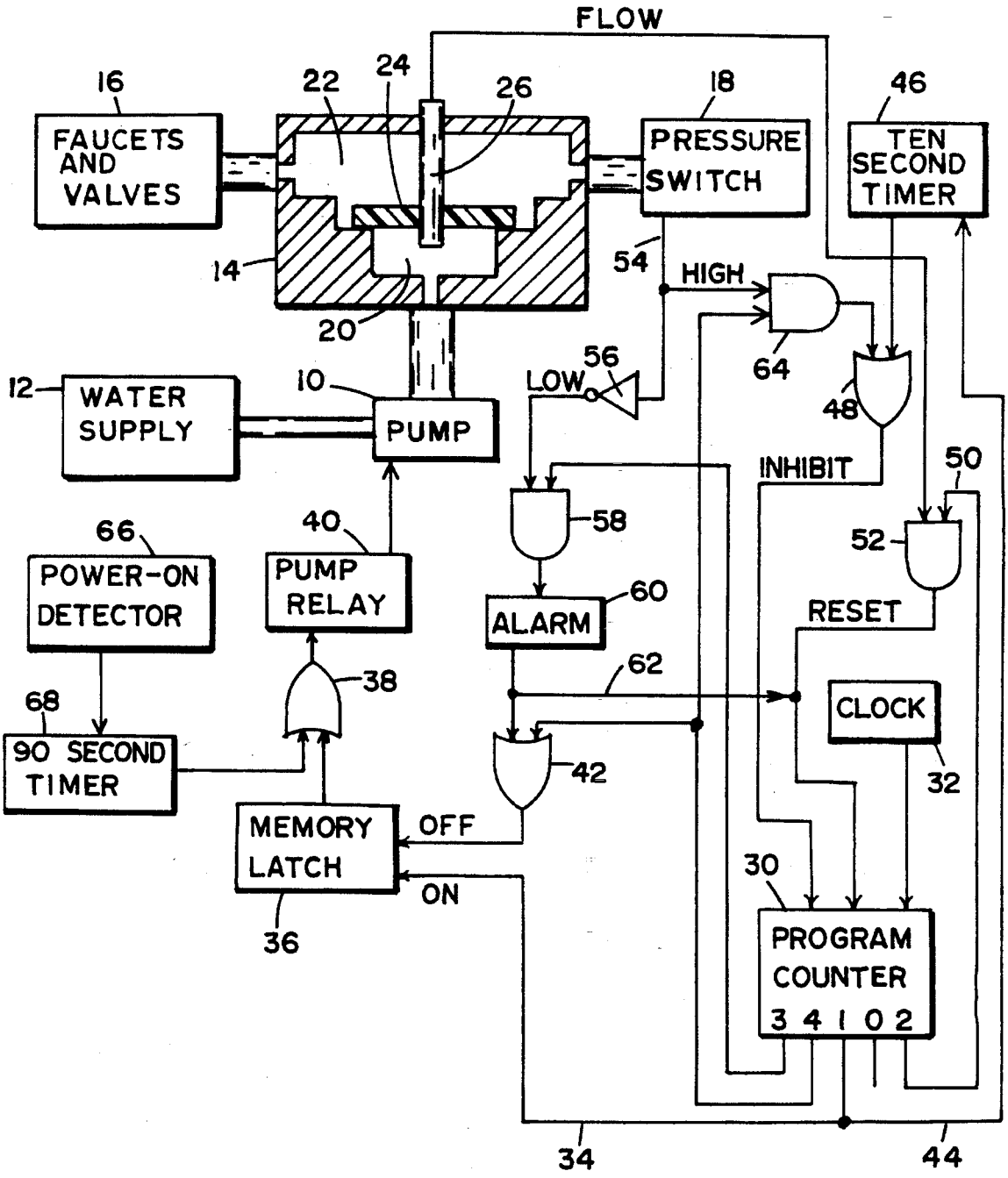
FLOW
16
FAUCETS AND VALVES
22
24
26
18
PRESSURE SWITCH
46
TEN SECOND TIMER
14
54
HIGH
20
64
56
LOW
12
WATER SUPPLY
10
PUMP
48
INHIBIT
50
58
52
66
POWER-ON DETECTOR
40
PUMP RELAY
ALARM
60
RESET
62
38
68
90 SECOND TIMER
CLOCK
42
32
MEMORY LATCH
OFF
ON
30
36
PROGRAM COUNTER
3 4 1 0 2
34
44

WATER PRESSURE CONTROL SYSTEM

TECHNICAL FIELD

This invention relates to demand water supply systems, and control systems therefor, especially systems in which water pressure is sustained between selected limits by pumps.

BACKGROUND OF THE INVENTION

Typical prior art demand water pressure maintenance systems monitor the pressure with a pressure switch. When the pressure drops below a selected level, the switch activates relays or acts directly to a pump that raises the pressure of the water. When the pressure reaches a higher selected level, the switch opens and cuts off power to the pump. In order to keep the switch and pump from rapidly cycling on and off, the turn on pressure is usually selected to be 20 to 30 psi below the turn off pressure. This is usually achieved in the art with a single mechanical switch that can be set to turn on and off at different pressures. However, since water is essentially incompressible, even a small amount of pumping quickly eliminates the 20 to 30 psi difference so that the switch and pump will still cycle on and off very fast. This could burn up the switch contacts and the pump motor. Hence, prior art water systems must use an accumulator tank into which the pressurized water flows and compresses a compressible gas such as air. In this way, the pump motor stays on longer while the air is compressed in the accumulator tank. After the pump turns off, it remains off for a longer time while the compressed air in the accumulator sustains pressure in the water system. It would be nice to eliminate the need for this accumulator tank which is expensive, heavy, and space consuming, especially a problem for water pressure systems installed in boats, recreational vehicles, and the like.

Another prior art problem is that the selected high pressure turn off point must be kept well below the maximum capability of the pump to take into account manufacturing tolerances in the pressure switch and possible voltage variations. Thus, the full capacity of the pump is never realized, which is inefficient. Also, the on and off pressure settings are closer together so that, once again, cycling of the switch and pump is increased. The present invention avoids these problems with a control system that does not need an accumulator tank and makes available the full pumping capability of the pump.

SUMMARY OF THE INVENTION

Briefly, this inventive water pressure control system utilizes a pressure switch only to sense low pressure and turn the pump on. An independent flow switch detects the flow of water through the system and turns the pump off if the flow stops or becomes too low. Consequently, as long as some water is being consumed, so that a minimal flow is maintained, the pump continues to operate and deliver its full pressure to the system, rather than being prematurely cut off. Ultimately, this means that smaller, less expensive pumps can be used. An electronic logic circuit samples the pressure and flow hundreds of times a second and initiates the actions of: (1) starting the pump when the pressure is low; (2) stopping the pump when the flow is too low; (3) activating an alarm and disabling the pump when both the flow and pressure are low which indicates a blockage or a dry supply tank. In addition, the logic circuits introduce various time delays before turning the pump off so as to smooth the operation of the system and eliminate rapid on and off cycling during unusual circumstances such as priming of the system or slowly dripping faucets.

The present invention, thus, eliminates the need for an accumulator tank and also permits smaller less expensive pumps to be used and maximum pump pressure to be delivered at all times. Additional benefits and advantages will become apparent upon consideration of the following more detailed description and the drawing referenced thereby.

BRIEF DESCRIPTION OF THE DRAWING

The drawing FIGURE shows schematically the pressure control system of this invention including a sectional elevation of a possible flow detecting switch design.

DETAILED DESCRIPTION OF THE INVENTION

In the drawing, a pump 10 is shown which takes water from a supply 12 and pumps it through a flow detecting means or switch 14 to the various outlet faucets and valves 16. A pressure detecting means or switch 18 is also connected to measure the pressure of the water in the system. The flow switch 14 is shown in section to reveal its operation. In order for water from pump 10 to flow to the faucets 16, it passes from a chamber 20 to a chamber 22 and lifts an annular, disc shaped magnet 24 upwards. Magnet 24 slides along an encapsulated, position sensing, reed switch 26. Switch 26 is a commercially available switch that is designed to operate when a magnet moves along its length. Thus, a small flow of water will displace magnet 24 and trigger switch 26. In the preferred embodiment, chambers 20 and 22, and the magnet are sized to detect a flow of about 3 to 5 percent of the maximum flow capacity of the pump. But this may vary for other type systems or pumps.

Since magnet 24 rests in place by gravity, the orientation of flow switch 14 should be upright as shown. However, magnet 24 could be held in place with a spring allowing operation in any position. This configuration, however, puts more parts in the water flow path which increases maintenance requirements. The preferred embodiment contemplates that the flow switch 14 would be an integral part of the pump although it is here shown separately for clarity.

The logic control circuits are operated and sequenced by a commercially available, well known, program counter 30 that generates sequential signals on output pins zero through four. The rate of the sequencing is controlled by a clock 32, typically operating at hundreds of hertz. The "zero" output is unconnected, as shown. The "one" output is used to start the pump. The signal is conveyed on a line 34 to set a memory or latch 36 to the "on" state. This "on" signal is conveyed through an OR gate 38 to operate a pump relay 40 and supply power to pump 10. Pump 10 continues to run until relay 40 is deactivated by latch 36, which is changed to the "off" state by an "off" signal from an OR gate 42.

The "one" output from counter 30 is also transmitted on a line 44 to a ten second timer 46. Timer 46 produces a signal for ten seconds that is passed through an OR gate 48 to the inhibit input of the program counter 30. This inhibits counter 30 from advancing beyond the "one" output condition for the ten second duration of the signal from timer 46. As a result, once the pump has been started, it continues to run for at least ten seconds. Smoother operation is thereby assured, without a lot of rapid on and off switching, and sufficient time for a measurable flow to develop at the flow switch 14 is guaranteed. Of course, the ten second period is merely a design choice. A large range of time delays would no doubt work satisfactorily, from as low as one second to as high as sixty seconds.

After the ten seconds expires, the inhibit signal ceases and the counter 30 advances to the "two" output pin. This signal is transmitted on line 50 to an AND gate 52 along with a signal from flow switch 14. If flow has begun during the ten second interval, the flow lifts magnet 24, which activates reed switch 26, and produces a flow signal to AND gate 52. Gate 52, receiving both a flow signal and a "two" signal, generates a signal to the reset input of counter 30, which resets counter 30 to the "zero" output. Once again, counter 30 advances to the "one" output and begins another ten second inhibit or delay as described above. Hence, as long as there is a flow of water, counter 30 rotates through the "zero", "one", and "two" outputs every ten seconds, and the pump 10 remains on. It can be seen that pump 10 is allowed to develop its maximum pressure and is not prematurely shut down just because low flow has allowed the pump to raise the pressure in the system, or an accumulator tank, to some cut off value. And whereas a prior art accumulator tank would allow the pressure to fade as water is consumed, until the pump starts again, the present invention always allows the maximum pressure of the pump to be delivered to the faucets. Accordingly, a more consistent and higher pressure is always presented to the faucets. By contrast, prior art accumulator tank systems produce an always changing pressure that varies between the pressure switch settings. This can be quite vexing when, for example, one is taking a shower.

If flow falls below that necessary to move magnet 24, the reset signal will not be produced and counter 30 advances to the "three" output pin. This causes the pressure switch 18 to be interrogated. If there is pressure present, a signal is generated on a line 54. This signal is inverted by invertor 56 and presented to an AND gate 58 along with the "three" output. The inverted high pressure signal is, of course, zero so that AND gate 58 has no output. However, if there is low or no pressure measured by switch 18, the inverted signal will be high at gate 58. The detection of both low flow and low pressure indicates a dry supply 12 or an obstruction. Thus, the output generated by AND gate 58 is used to trigger an alarm 60, which could be a light or an audible alarm. Also, the alarm output is conveyed through OR gate 42 to set latch 36 to the "off" state and, thereby turn off pump 10. Alarm 60 also generates a continuous reset signal on line 62 to hold counter 30 at zero until corrective action is taken.

If, however, the pressure is high, then the lack of flow is a consequence simply of lack of demand. There is no alarm, and no reset signal on line 62, and counter 30 advances to output "four". This signal is conveyed through OR gate 42 to turn off latch 36 and pump 10. Output "four" is also presented to an AND gate 64, together with the high pressure signal from switch 18 to generate an inhibit signal through OR gate 48 which holds counter 30 at output "four" so that the pump remains off as long as there is pressure. When additional demand for water lowers the pressure, the inhibit signal ceases, counter 30 advances again to output "zero", and then "one", and the pump is again turned on as described already.

In the special circumstance when the system is first turned on, it may take more than ten seconds to prime the pump with water. For trouble free operation, the present invention includes a power-on detector circuit 66 that starts a ninety second timer 68. Timer 68 produces a signal that turns on pump 10, working through OR gate 38, for a ninety second interval, regardless of the commands from the rest of the control circuits. This assures an adequate time for the pump to prime. Again, ninety seconds is a design choice, and shorter or longer intervals may better suit other types of pumps.

Clearly, many variations may be made to the disclosed preferred embodiment. Many types of flow detecting switches are commercially available that will serve the functional requirements of the control circuit, although they may be more expensive and less reliable than the magnetic design of the instant invention. The specific electronic components and the chosen sequence of operations are not critical provided a system is provided that activates the pump in response to low pressure, but stops the pump only in response to low flow. Hence, the invention should not be limited to the specific disclosed elements but only by the appended claims and their equivalents.

I claim:

1. A water pressure control system comprising in combination:

a pump operable to pump water from a source to a desired destination;

pressure measuring means to measure the pressure of water from said pump;

flow measuring means to measure the rate of flow of water from said pump;

control means connected to both of said measuring means and operable to turn on said pump when the water pressure falls below a selected pressure, and further operable to turn off said pump only in response to the flow of water falling below a selected rate.

2. The system of claim 1 in which said control means is also operable to turn off the pump and activate an alarm when both the pressure is below said selected pressure and the flow is below said selected rate.

3. The system of claim 1 in which said control means includes delay means that prevents the pump from being turned off in response to low water flow for a chosen interval after the pump has been turned on.

4. The system of claim 1 in which said control means includes a power-on detecting means to sense the application of power to the system, and priming means operable to turn on the pump for a priming interval, in response to the detection of said application of power by said detecting means.

5. The system of claim 1 in which said flow measuring means comprises a magnetic member disposed in the flow path of water from the pump in such a way as to be moved by a flow of water, and a magnetically sensitive switch proximate said magnetic member adapted to produce a signal in response to the movement of said magnetic member.

6. The system of claim 2 in which said control means includes delay means that prevents the pump from being turned off in response to-low water flow for a chosen interval after the pump has been turned on.

7. The system of claim 6 in which said control means includes a power-on detecting means to sense the application of power to the system, and priming means operable to turn on the pump for a priming interval, in response to the detection of said application of power by said detecting means.

8. The system of claim 7 in which said flow measuring means comprises a magnetic member disposed in the flow path of water from the pump in such a way as to be moved by a flow of water, and a magnetically sensitive switch proximate said magnetic member adapted to produce a signal in response to the movement of said magnetic member.

9. The system of claim 6 in which said control means includes a pump relay means operable to supply power to said pump, a latch means operable to activate said relay means, and a program counter adapted to generate zero, first, second, third, and fourth sequential outputs, the zero output being unconnected, the first output connected to set said latch means to the on state so as to activate said relay means and start said pump, said first output also connected to said delay means so as to begin the production of an inhibit signal for said chosen interval, which inhibit signal is directed to the program counter to prevent advancement from the first output to the second output for said chosen interval, the second output connected to a reset AND gate together with the signal from said flow measuring means so that said reset AND gate produces a reset signal if there is water flow, which reset signal is directed to the program counter to reset it to the zero output, the third output connected to activate, in cooperation with a low pressure signal from said pressure measuring means, the alarm, the alarm also operable, when activated, to set said latch means to the off state, stopping the pump, and reset said program counter to the zero output, and the fourth output connected to the latch means so as to set said latch means to the off state and stop the pump, said fourth output also connected to generate an inhibit signal, in cooperation with a pressure signal from said pressure measuring means, to said program counter so as to prevent advancement from the fourth output to the zero output until water pressure declines.

10. The system of claim 9 in which said control means includes a power-on detecting means to sense the application of power to the system, and priming means operable to turn on the pump for a priming interval, in response to the detection of said application of power by said detecting means.

11. The system of claim 10 in which said flow measuring means comprises a magnetic member disposed in the flow path of water from the pump in such a way as to be moved by a flow of water, and a magnetically sensitive switch proximate said magnetic member adapted to produce a signal in response to the movement of said magnetic member.

* * * * *